United States Patent [19]

Smith et al.

[11] Patent Number: 4,877,427

[45] Date of Patent: Oct. 31, 1989

[54] DRY ELECTROSTATIC PRECIPITATOR

[75] Inventors: Charles G. Smith, West Bromwich; Terence B. F. Cottrell, nr. Walsall, both of England

[73] Assignee: Dresser U.K. Limited, A British Company, London, England

[21] Appl. No.: 191,501

[22] Filed: May 9, 1988

[30] Foreign Application Priority Data

May 15, 1987 [GB] United Kingdom ..... 8711487

[51] Int. Cl.[4] ..... B03C 3/00

[52] U.S. Cl. ..... 55/136

[58] Field of Search ..... 55/136, 137

[56] References Cited

U.S. PATENT DOCUMENTS 2,061,045 11/1936 Ruder et al. ..... 55/136

FOREIGN PATENT DOCUMENTS 445258 4/1936 United Kingdom ..... 55/136

OTHER PUBLICATIONS

"Development of Dry Type Blast Furnace Gas Energy Recovery System" by Norio Saito, *Nippon Kokan Technical Report, Overseas No.* 46, 1986.

"A New Precipitator for Partially Burned BOF and Q-BOP Waste Gas" by Dr. Rolf K. Rennhack et al, *Iron and Steel Engineer,* Sep. 1978.

*Primary Examiner*—Bernard Nozick

*Attorney, Agent, or Firm*—Daniel Rubin

[57] ABSTRACT

An electrostatic precipitator comprises an upright cylindrical vessel (10) containing a number of vertically spaced precipitator stages (12). Ducting (18) provides a path for gas flow from an inlet (14) to an outlet (15) passing successively through each of the precipitator stages (12).

4 Claims, 1 Drawing Sheet

DRY ELECTROSTATIC PRECIPITATOR

This invention relates to a dry process electrostatic precipitator particularly useful when the gas pressure is elevated or when ground space is limited.

The gas produced during the melting of iron ore in a blast furnace is of a relatively low calorific value but is available in such quantities that it has long been recognised a valuable fuel within the works complex. Before it can be used, however, it must be cooled and cleaned and over the years numerous processes have evolved to treat the gas prior to it entering the works fuel gas system.

A modern plant for treating blast furnace gas aims to recover not only the gas itself but also its pressure energy (the gas emerges from the blast furnace typically at a pressure of between 1.5 and 2.0 bar gauge) and its sensible heat content (the gas temperature is typically in the region of 150° to 200° C.). This can be achieved if the gas is supplied while still hot and dry to a power generating turbine but the manufacturers of such turbines set a maximum inlet particulate loading to their machines of 5 mg/Nm$^3$. There is thus a requirement for a dry precipitator capable of cleaning the gas from its initial dirty condition (typically 8.10 g/Nm$^3$) to the standard required at the turbine inlet.

It is an object of the present invention to provide such a precipitator.

The present invention is a dry process electrostatic precipitator comprising a number of vertically spaced precipitator stages within an upright cylindrical vessel, and ducting for passing a gas from an inlet to an outlet through the precipitator stages in succession, each stage having a dust hopper located beneath it, dust chutes extending from the hoppers to discharge outlets at the bottom of the vessel.

Figure 1:
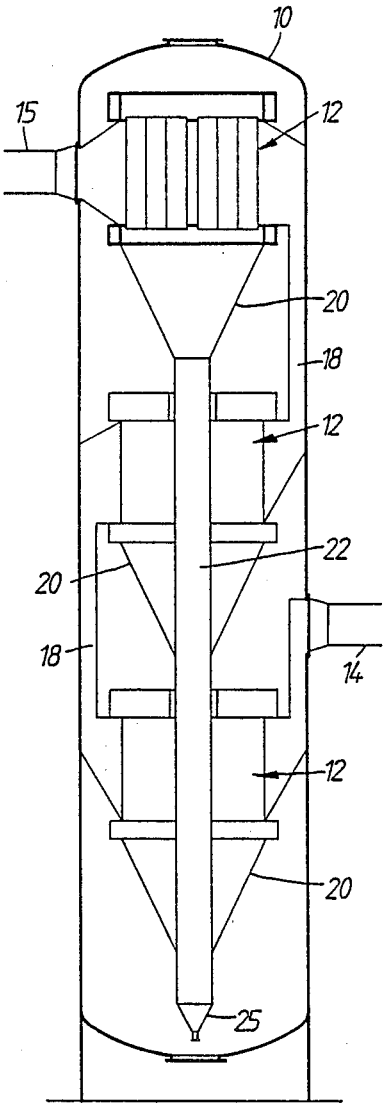
Figure 2:
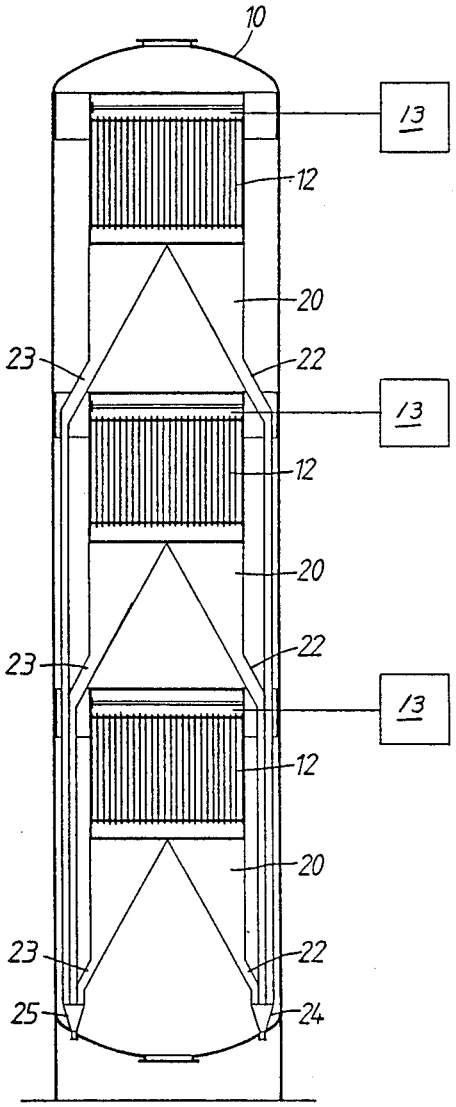

An embodiment of the present invention will now be described, by way of example, with reference to the accompanying drawings, in which:

FIG. 1 is a schematic front elevation of a precipitator according to the present invention; and FIG. 2 is a schematic side elevation of the precipitator of FIG. 1.

Referring now to the drawings, a precipitator comprises a vertical cylindrical vessel 10 containing a number (in this embodiment three) of horizontal flow precipitator stages 12 supported on members extending across the vessel. Gas from the blast furnace enters the precipitator at inlet 14 and is led from there through the precipitator stages 12 in sequence from the lowermost stage to the topmost stage whence it passes to an outlet 15. As seen in FIG. 1 the vertical ducting 18 leading from one stage to the next is provided alternately at two diametrically opposed regions of the vessel 10.

Each precipitator stage 12 has an associated electrical power source 13 and a dust hopper 20 which discharges to two dust chutes 22 and 23 which are located in diametrically opposed regions of the vessel 10, equally spaced between the regions for the vertical ducting 18. The dust chutes 22 and 23 from the various precipitator stages 12 discharge through respective outlets 24 and 25 at the bottom of the vessel 10.

To avoid excessively large diameter vessels 10 a number of precipitators may be used in parallel to handle the output of a blast furnace. The outputs of the precipitators may, of course, be supplied in common to a turbine or separately to respective turbines as plant economy and circumstances dictate.

Modifications may be made to the embodiment described. For example, the dust hoppers could be redesigned so that only a single dust chute per hopper is required, and conveyors could be substituted for the gas chutes. Also the gas flow could be from the top to the bottom of the precipitators.

It should of course be understood that each precipitator stage is conventional in construction, power supply and rapping mechanisms though of course each stage is separately controlled to reflect the progressively changing conditions of operation.

We claim:

1. A dry electrostatic precipitator for removing dust particulates from a flowing gas stream and comprising an upright cylindrical vessel, a plurality of precipitator stages secured vertically spaced within said cylindrical vessel, each of said precipitator stages having particulate charging electrodes and associated collector electrodes and arranged in a controlled flow path effecting horizontal flow of a received gas past said electrodes with the charging electrodes of each stage being operatively controlled separately from the charging electrodes of the other of said stages, and ducting for passing the received gas from an inlet to an outlet through the precipitator stages in succession in said controlled flow path to flow horizontally through said precipitator stages and vertically between said stages, a dust hopper located beneath each stage; and dust chutes extending from the hoppers to discharge outlets at the bottom of the vessel.

2. A precipitator as claimed in claim 1, in which said ducting between adjacent stages is peripherally spaced equally from the dust chutes.

3. A precipitator as claimed in claim 1, in which there are at least three precipitator stages.

4. A precipitator as claimed in claim 1, including two dust chutes and each of said dust hoppers communicates with said two dust chutes for discharging collected dust thereto.

* * * * *